US007070057B2

(12) United States Patent
Moss et al.

(10) Patent No.: US 7,070,057 B2
(45) Date of Patent: Jul. 4, 2006

(54) FOLDABLE DISPLAY STAND WITH SELF ERECTING STABILIZING BASE

(75) Inventors: Geoffrey Alan Moss, Maple (CA); David Brian Minister, Toronto (CA)

(73) Assignee: Poptech Limited, Toronto (CA)

( * ) Notice: Subject to any disclaimer, the term of this patent is extended or adjusted under 35 U.S.C. 154(b) by 176 days.

(21) Appl. No.: 10/700,259

(22) Filed: Nov. 4, 2003

(65) Prior Publication Data

US 2005/0092705 A1 May 5, 2005

(51) Int. Cl.
*A47F 3/14* (2006.01)

(52) U.S. Cl. ..... 211/132.1

(58) Field of Classification Search ..... 211/132.1, 211/73, 149; 248/174, 459; 206/45.24, 206/45.25, 45.26, 45.27
See application file for complete search history.

(56) References Cited

U.S. PATENT DOCUMENTS 1,698,686 A * 1/1929 Ziemmerman ..... 108/100
2,474,659 A * 6/1949 Ebert ..... 248/459
3,727,874 A * 4/1973 Wuensch ..... 248/459
4,619,426 A * 10/1986 Drueck, Jr. ..... 248/174
4,723,664 A * 2/1988 Smith ..... 211/149
5,540,335 A * 7/1996 Friedman ..... 206/756
5,542,551 A * 8/1996 Smith ..... 211/150
5,620,104 A * 4/1997 Maglione ..... 211/59.1
5,692,714 A * 12/1997 Morrison ..... 248/174
5,782,452 A * 7/1998 Bosworth ..... 248/459
5,868,367 A * 2/1999 Smith ..... 248/174

* cited by examiner

*Primary Examiner*—Sarah Purol
(74) *Attorney, Agent, or Firm*—David W. Wong

(57) ABSTRACT

Foldable display stands with a vertical board for showing merchandise are provide with a self erecting base to provide stability to the stand when merchandise is placed or mounted on the stand. The stand two has parallel vertical easel panels mounted at its rear surface and are either foldable to lie juxtaposed to the rear surface or self erected to support the vertical board to rest in a substantially vertical manner on a supporting surface. The base is foldable along a vertical center line of its two side panel to a collapsed condition. A rectangular top panel or two rectangular top panels may be provide in the base when the base is generally rectangular in shape. The stabilizing base is self erecting with elastic cords mounted between the side panels and top panels of the base and the vertical board.

14 Claims, 7 Drawing Sheets

FOLDABLE DISPLAY STAND WITH SELF ERECTING STABILIZING BASE

FIELD OF THE INVENTION

This invention relates to display stands for displaying merchandise and particularly to vertical cardboard type display stands having a self erecting supporting base for stabilizing the stand when various merchandise items are placed thereon.

BACKGROUND OF THE INVENTION

Stands made of cardboard are commonly used for displaying merchandise. Such stands are made of corrugated or card board material and have a vertical board extending upward vertically from a relatively large supporting base and the board inclines slightly backwards to provide better stability to prevent the stand from tipping forward when the merchandise is placed thereon. The stand is constructed by a single design pattern formed on the cardboard material and it has various parts which may be manually folded and/or engaged together to form the display stand. Such stands are shown in U.S. Pat. No. 5,899,345 to S. M. Fuller and U.S. Pat. No. 6,098,820. Due to the complexity of the design pattern and the numerous parts that must be folded and engaged together manually, such stands are time consuming and awkward to erect.

Some known stands such as that shown in U.S. Pat. No. 4,570,805 to I. Smith are provided with a self erecting base to facilitate their erection. However, the entire self erecting base of such stand is complex in structure, and it is subject to operating problems as it would readily become inoperative in use. Furthermore, the entire stand as a whole is difficult to fold into a collapsed condition for transportation and storage.

SUMMARY OF THE INVENTION

It is a principal object of the present invention to provide merchandise display stands which are self erecting and are easily foldable into a collapsed condition for transportation and storage.

It is another object of the present invention to provide merchandise display stands which include a self erecting base to provide stabilizing when merchandise is placed on the stand.

It is another object of the present invention to provide merchandise display stands having a stabilizing base which is easily foldable into a collapsed condition and is also self erecting to support the stand.

It is yet another object of the present invention to provide display stands having accessories adaptable for showing merchandise of various types and sizes.

It is still another object of the present invention to provide display stands which are erectable easily and quickly.

DETAILED DESCRIPTION OF THE PREFERRED EMBODIMENTS OF THE INVENTION

Figure 1:
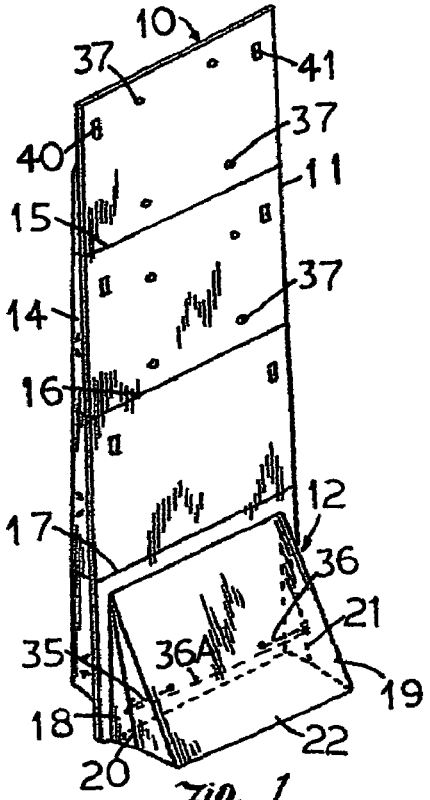
FIG. 1 is a perspective front elevation view of the foldable self erecting merchandise display stand according to the present invention.
Figure 2:
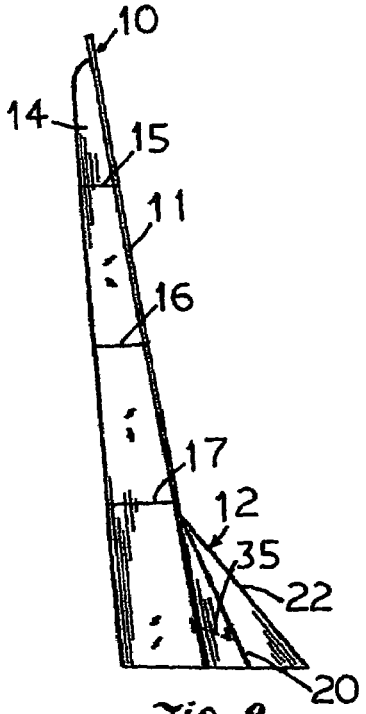
FIG. 2 is a left side elevation view of the display stand.
Figure 3:
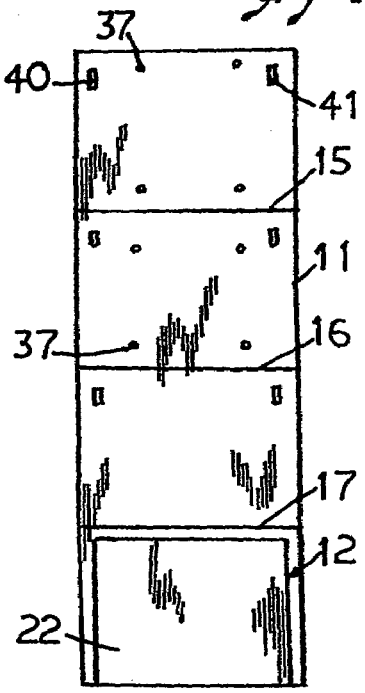
FIG. 3 is a front elevation view thereof.
Figure 4:
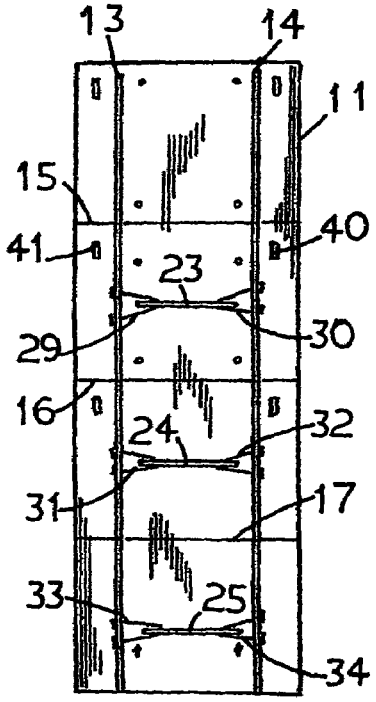
FIG. 4 is a rear elevation view thereof.
Figure 5:
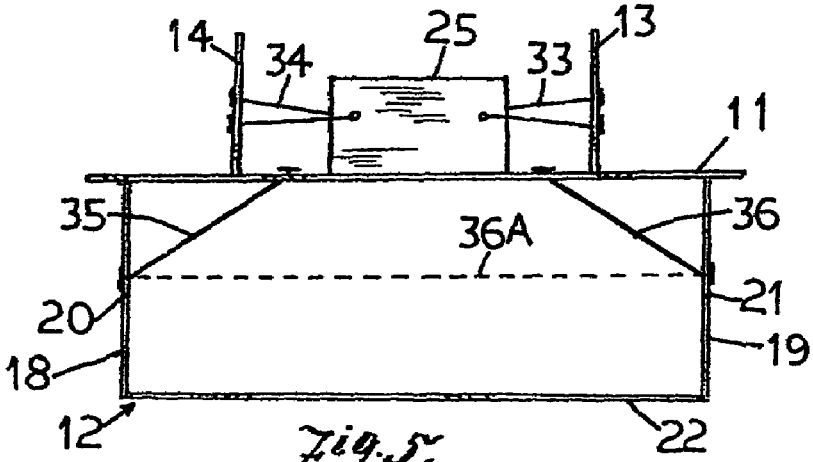
FIG. 5 is an enlarged bottom elevation view thereof.
Figure 6:
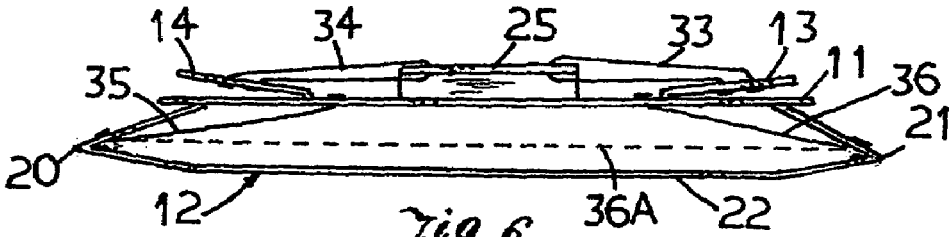
FIG. 6 is an enlarged bottom elevation view of the display stand in the partially collapsed and folded condition.

With reference to the drawings, the display stand 10 of the present invention has a vertical board 11 extending upwards from a supporting base 12. Two parallel vertical easel panels 13 and 14 are provided at the rear surface of the vertical board 11. The easel panels 13 and 14 are foldable relative to a vertical joint together with the vertical board 11 such that they may be folded to lie contiguous to the vertical board 11 or pivoted to an erected condition perpendicular to the vertical board 11 for supporting the display stand 10 to stand securely on a supporting floor. The vertical board 11 is preferably inclining rearwards slightly in the upstanding position in order to provide better stability for the display stand when the merchandise is mounted on the vertical board 11.

The vertical board 11 and the easel panels 13 and 14 of the display stand 10 are foldable along horizontal fold lines 15, 16, and 17 into a collapsed condition. The supporting base 12 has triangular side walls 18 and 19 which are foldable along their middle vertical lines 20 and 21 by pushing the side walls 18 and 19 outwards at the middle vertical lines 20 and 21 so that its front panel 22 will move to abut the vertical board 11 in a collapsed condition.

Figure 7:
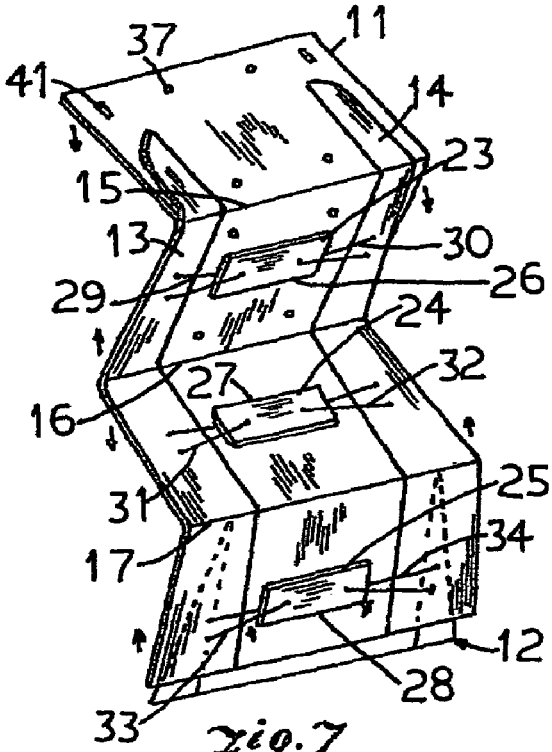
FIG. 7 is a rear elevation view of the display stand showing the folding of various portion during the folding operation.
Figure 8:
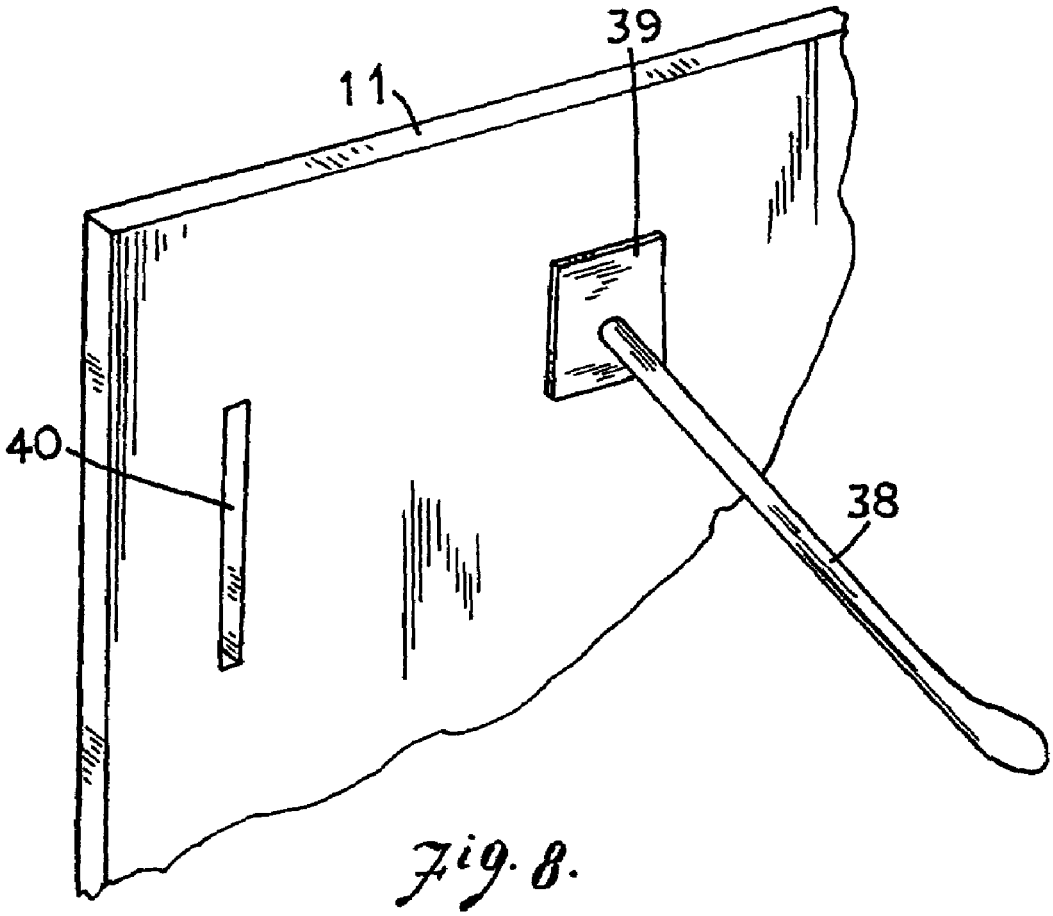
FIG. 8 is an enlarged isolated partial front elevation view of the display stand illustrating the mounting of the cantilever bar on the vertical board therein for showing the merchandise.
Figure 9:
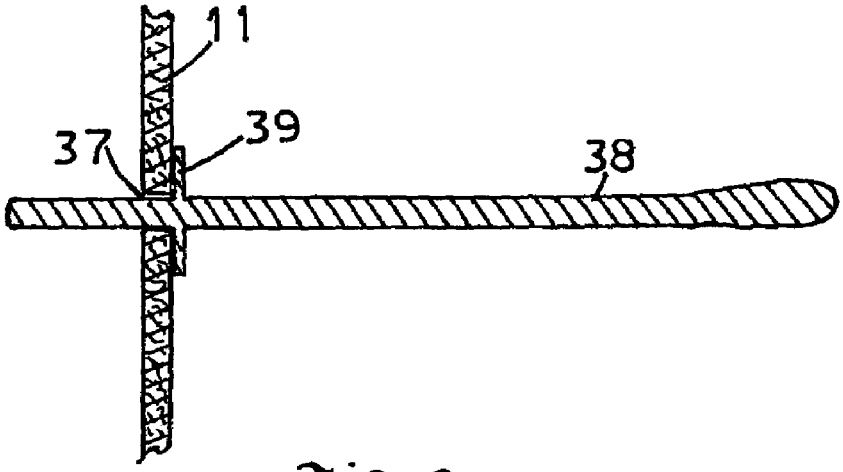
FIG. 9 is an enlarged isolated side sectional elevation view showing the insertion of the cantilever bar on the vertical board of the display stand.
Figure 10:
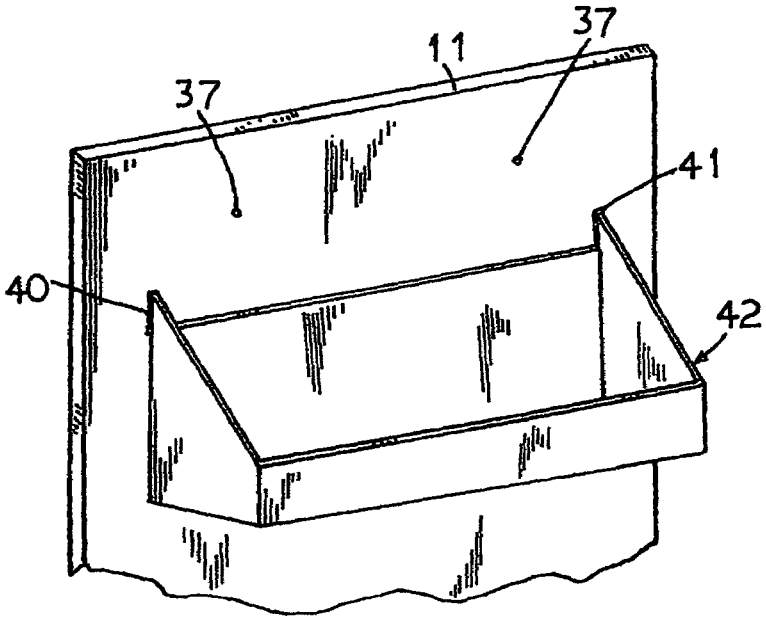
FIG. 10 is an enlarged isolated front elevation view showing the mounting of a merchandise tray to slots formed in the vertical board portion of the display stand.
Figure 12:
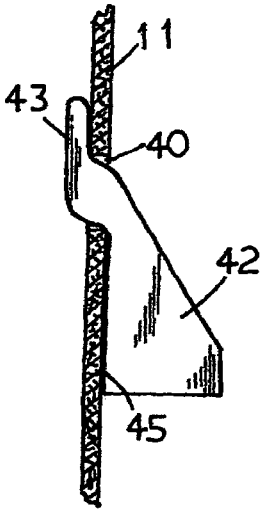
FIG. 12 is an enlarged isolated partial sectional elevation view showing the manner the merchandise tray is removably mounted to the slot formed in the vertical board portion of the display stand.
Figure 11:
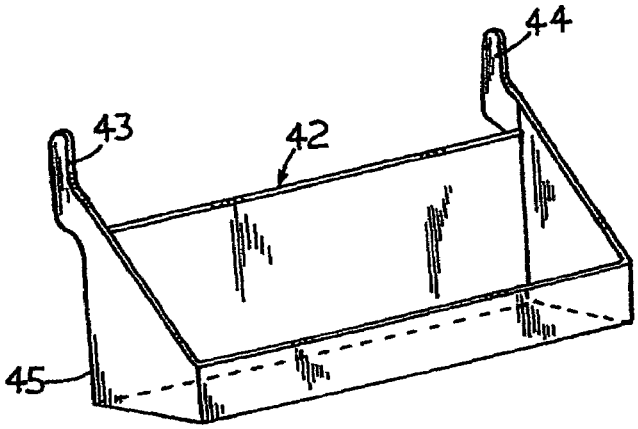
FIG. 11 is an enlarged perspective front elevation view of the merchandise tray.
Figure 13:
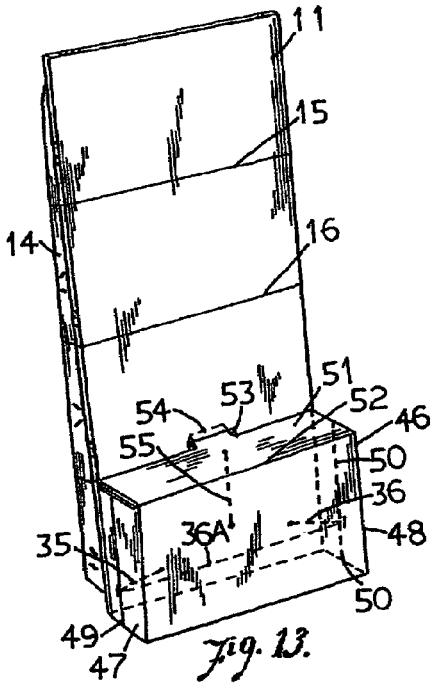
FIG. 13 is a perspective front elevation view a second embodiment of the display stand of the present invention having a substantially rectangular supporting base.

Horizontal braces 23, 24 and 25 pivotable along horizontal joints 26, 27 and 28 are mounted on the rear surface of the vertical board 11; and elastic cords 29, 30, 31, 32, 33 and 34 are mounted between the horizontal braces 23, 24 and 25 and the easel panels 13 and 14 respectively such that when the easel panels 13 and 14 may be folded to juxtapose the vertical board 11 for folding the display stand 10 to a collapsed condition as best shown in FIG. 7, the elastic cords 29, 30, 31, 32, 33 and 34 are in elastic tension when the vertical board 11 and the easel panels 13 and 14 are in the folded collapsed condition. Elastic cords 35 and 36 are mounted between the middle vertical lines 20 and 21 of the side panels 18 and 19 to the vertical board 11. The stabilizing base portion 12 are folded into a collapsed condition by pushing the side panels 18 and 19 outwards at the middle vertical lines 20 and 21 against the elastic tension of the elastic cords 35 and 36 prior to folding the vertical board 11 and the easel panels 13 and 14 into the collapsed condition. The display stand 10 may be erected from the folded condition by simply holding the top edge of the vertical board and raising the folded board upwards. The elastic cords in elastic tension will automatically pull the folded board and the easel panels back to the erected condition; in the meantime, the elastic cords 35 and 36 will pull the side panels 18 and 19 back to their erected positions. Thus, the display stand 10 and its stabilizing base portion 12 are self erecting from their collapsed condition. Alternatively, a single elongated elastic cord 36A as shown in dotted line may be mounted between the middle vertical lines 20 and 21 of the side panels 18 and 19 to provide the same function as the twin elastic cords 35 and 36.

A plurality of rows of through openings 37 are formed in the vertical board 11; for simplicity of illustration, eight through openings are shown in the drawings. Merchandise hanging rods 38 may be inserted into these through openings in a cantilever manner for hanging merchandise thereon. The hanging rod 38 has a flat rear plate 39 which abuts the vertical board portion 11 for maintaining the hanging rod 38 in a securely mounted position. The hanging rods 38 may be made of metal or plastic.

A plurality of pairs of vertical through slot openings 40 and 41 are also formed on the vertical board 11, for simplicity of illustration, three pairs of the slot openings are shown in the drawings. Merchandise trays 42 having generally L-shaped arms 43 and 44 extending upwardly and rearwardly from their upper rear corners may be removably mounted to the vertical board 11 by inserting the L-shaped arms 43 and 44 into the vertical through slot openings 40 and 41. The rear surface 45 of the merchandise tray 42 will press against the vertical board portion 11 when the merchandise tray 42 is in the mounted position.

Figure 14:
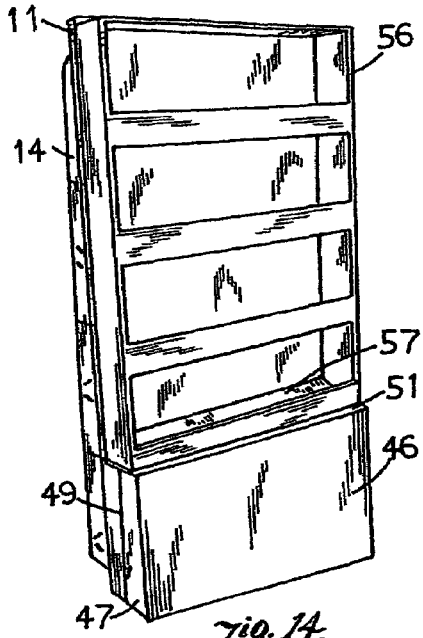
FIG. 14 is a perspective front elevation view showing a multi-tray shelving adaptable on the display stand of FIG. 13.
Figure 15:
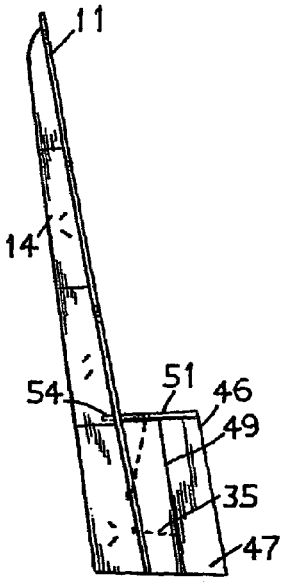
FIG. 15 is a side elevation view of the display stand of FIG. 13.
Figure 16:
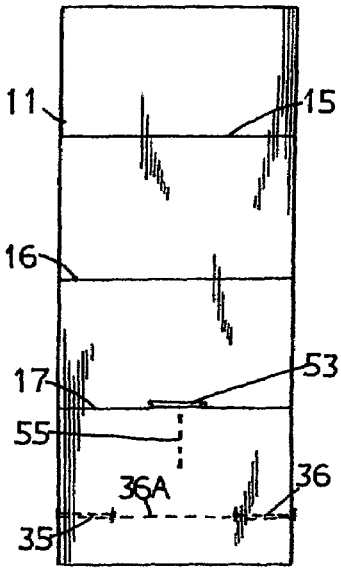
FIG. 16 is a front elevation view of the display stand of FIG. 13.
Figure 17:
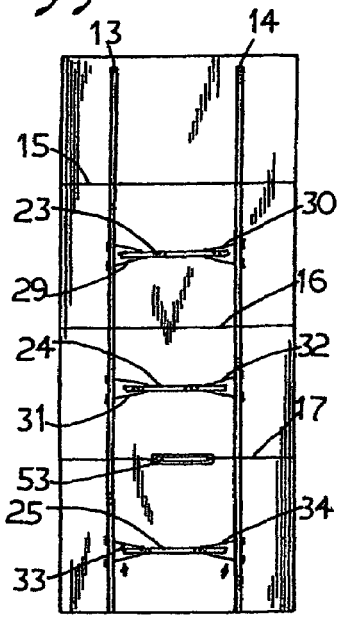
FIG. 17 is a rear elevation view of the display stand of FIG. 13.
Figure 18:
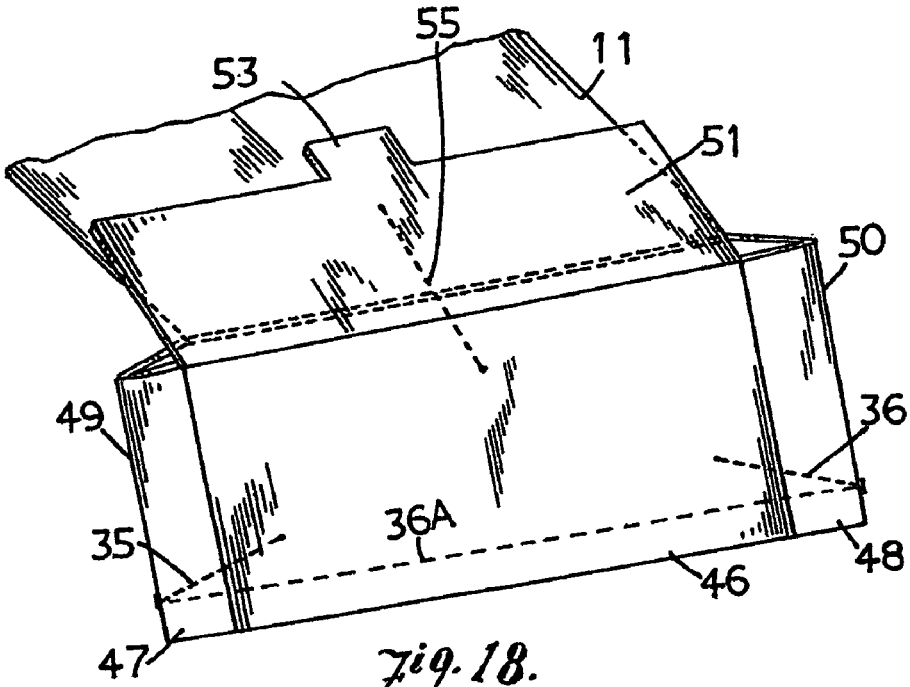
FIG. 18 is an enlarged isolated view of the stabilizing base of the display stand of FIG. 13 in a partially collapsed and folded condition.

A second embodiment of the display stand 10 of the present invention is shown in FIGS. 13 through 18 inclusive. In this embodiment, the display stand 10 has a substantially rectangular stabilizing base portion 46 having generally rectangular side panels 47 and 48 which have vertical center fold lines 49 and 50. Elastic cords 35 and 36 are mounted between the rectangular side panels 47 and 48 and the vertical board 11, which are in a relax state when the display stand 10 is in the erected condition. The base portion 46 has a generally rectangular top panel 51 which is hingedly connected to the top front edge 52 of the base portion 46 such that the top panel 51 is pivotable relative to the top front edge 52. The top panel 51 has a small central extension arm 53 extending rearwards from the center of the rear edge of the panel. The extension arm 53 will engage with a horizontal slot opening 54 formed in the vertical board portion 11 of the display stand when the top panel 51 is in the horizontal position so as to maintain the base portion in a secured erected state. An elastic cord 55 is mounted between the top panel 51 and the vertical board 11. The elastic cord 55 normally holds the top panel 51 in the horizontal position with the extension arm 53 engaging with the slot opening 54 of the vertical board 11 so as to maintain the base portion 46 in the erected condition. The base portion 46 may be transformed into a collapsed condition by first pulling the top panel 51 forward to disengage the extension arm 53 from the horizontal slot opening 54 and then turning the top panel 51 upwards relative to the hinge front edge 52 against the elastic tension of the elastic cord 55 and following by pushing the side panels 47 and 48 outward at the center lines 49 and 50 against the elastic tension of the elastic cords 35 and 36 until the front panel 56 is juxtaposed to the vertical board 11 as best shown in FIG. 18. The vertical board 11 may be folded into the collapsed condition as described in the first embodiment above. The collapsed display stand may be erected also as described previously by holding the top edge of the vertical board 11 and raising it upwards, the elastic tension of the elastic cords 29 through 34 between the easel panels 13 and 14, and the elastic cords 35 and 36 between the side panels 49 and 50 will pull the display stand 10 automatically back to the erected condition. While the elastic tension of the elastic cord 55 will pull the top panel 51 back to the horizontal position so that the extension arm 53 will engage with the horizontal slot opening 54 to maintain the display stand and the base portion 46 securely in the erected condition. A shelving 56 having a plurality of horizontal merchandise trays 57 may be removably located on the top panel 51 for displaying the merchandise as best shown in FIG. 14 when the display stand is in the erected condition.

Figure 19:
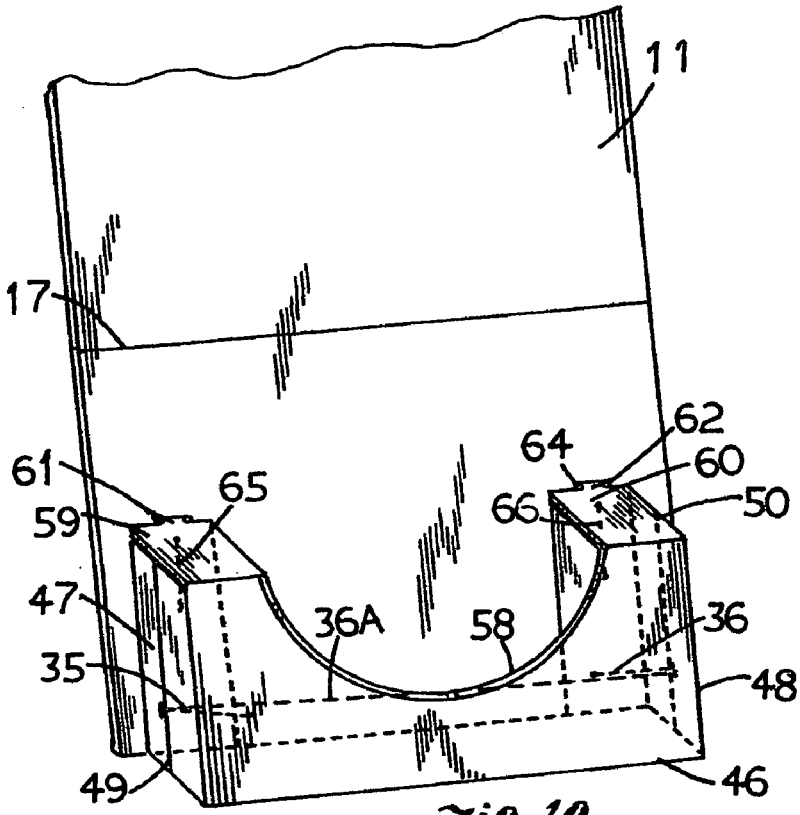
FIG. 19 is a partial front perspective view of another embodiment adaptable for showing a circular shaped merchandise such as an automobile tire.
Figure 20:
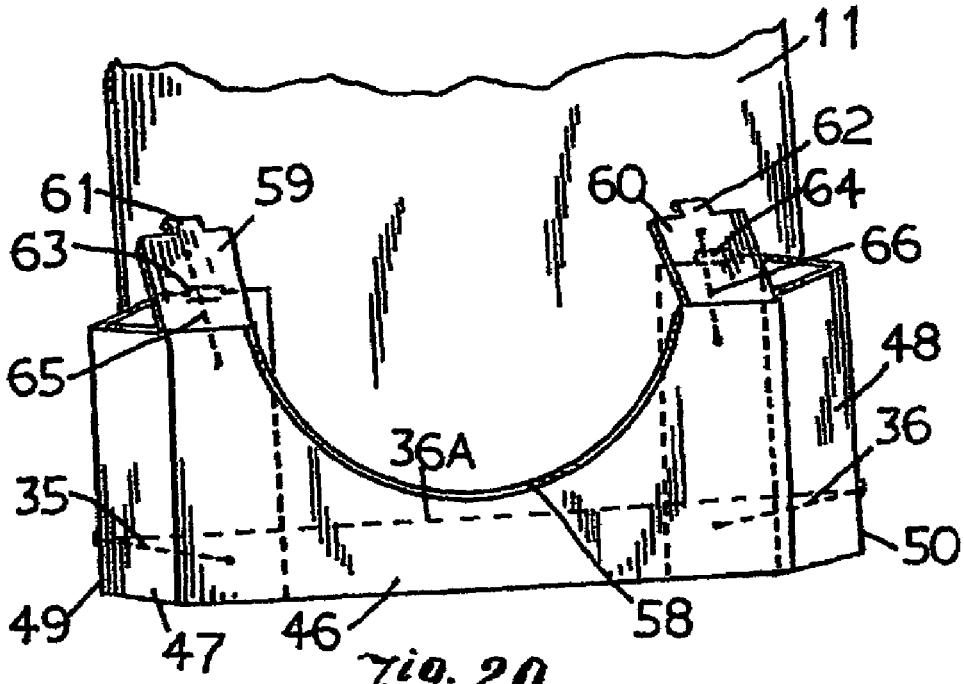
FIG. 20 is a partial front perspective view of the embodiment of the display stand of FIG. 19 in a partially folded condition.
Figure 21:
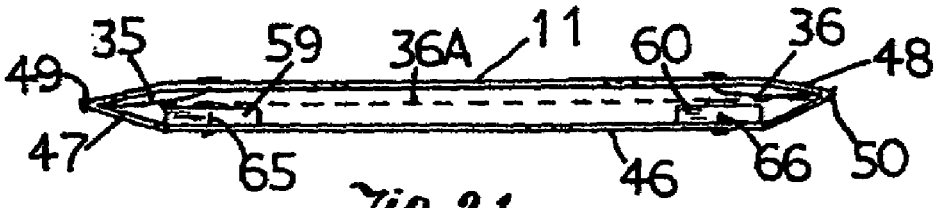
FIG. 21 is a bottom elevation of the embodiment of the display stand of FIG. 19 in a folded and collapsed condition.

A third embodiment of the display stand of the present invention is shown in FIGS. 19 to 21. This display stand of this embodiment may be used for displaying a circular object such as an automobile tire. This embodiment is closely similar to the second embodiment above, except a downwardly extending semi-circular cut out is formed in the upper portion of the front panel 46 to accommodate the circular shape of the tire, and two rectangular top panels 59 and 60 are provided. These top panels 59 and 60 have extension arms 61 and 62 formed at their rear center edge, and they will engage with horizontal slot openings 63 and 64 formed in the vertical board 11 when the top panels 59 and 60 are in the horizontal position. Elastic cords 65 and 66 are provided between the top panels 59 and 60 and the vertical board 11 to hold these top panels normally in the horizontal position. Similar to the second embodiment above, the base portion may be collapsed by first pulling the top panels 59 and 60 forwards until their extension arms 61 and 62 disengage from the slot openings 63 and 64 and then turning the top panels upwards against the elastic tension of the elastic cords 65 and 66, in the meantime, the side panels 47 and 48 are pushed outwards at their vertical center lines 49 and 50 against the elastic tension of the elastic cords 35 and 36 until the front panel 48 juxtaposed to the vertical board 11. The display stand in the collapsed condition may be self erected in the same manner as described previously.

Although the preferred embodiments of the present invention have been disclosed and described in detail above as examples, it should be understood that the invention is in no sense limited thereby, and its scope is to be determined by that of the following claims.

What is claimed is:

1. A foldable stand for displaying merchandise, comprising a vertical planar board foldable along a plurality of horizontal fold lines to a collapsed condition, two mutually parallel vertical elongated easel panels located at a rear surface of said vertical planar board along two vertical joint lines therein and being operative to support said vertical planar board to rest in a substantially upright manner on a supporting surface, said easel panels being foldable along said joint lines to lie in a flat condition juxtaposed to said rear surface of said vertical planar board and then foldable along said horizontal fold lines together with vertical planar board, a stabilizing supporting base located at a bottom front surface portion of said vertical planar board, said supporting base having two side panels extending outward from said front surface portion of said vertical planar board wherein each side panel has a vertical middle fold line, and said side panels being foldable along said vertical middle fold line to a collapsed condition, elastic cord means connected to between said side panels of said supporting base and being in an elastic tension when said side panels of said supporting base are folded in said collapsed condition.

2. A foldable stand according to claim 1 wherein said elastic cord means includes a first elastic cord member connected between one of said side panels of said supporting base and said vertical planar board, and a second elastic cord member connected between the other one of said side panels of said supporting base and said vertical planar board, said first elastic cord member and said second elastic cord member extending in a tension state when said side panels of said supporting base is in the folded and collapsed condition.

3. A foldable stand according to claim 1 including a plurality of rows of mounting openings formed in said vertical planar board, and adapted to receive merchandise mounting bars removably mounted to said vertical planar board in a cantilever manner.

4. A foldable stand according to claim 1 including a plurality of rows of vertical through slot openings formed in said vertical planar board, adapted to receive a plurality of merchandise display baskets removably mounted to said vertical planar board.

5. A foldable stand according to claim 4 wherein each of said baskets has two parallel generally L-shaped an extending upwards and rearwardly from upper corners of two side walls therein.

6. A foldable stand according to claim 5 wherein said base has a triangular side cross sectional shape with a front rectangular panel sloping downwardly and forwardly to a bottom edge operative to rest on said supporting surface when said stand is in an erected condition.

7. A foldable stand according to claim 6 including a plurality of brace members pivotally mounted in a horizontal manner at said rear surface of said vertical planar board, a plurality of first elastic cords mounted between said one of said elongated easel panels and one side of said brace members, and a plurality of second elastic cords mounted between the other one of said elongated easel panels and a second side of said brace members, said first of elastic cords and said elastic cords being in elastic tension when said easel panels are folded to lie juxtaposed to said rear surface of said vertical planar board.

8. A foldable stand according to claim 7 wherein said vertical planar board, said easel panels, said supporting base and said brace members are made of a cordboard material.

9. A foldable stand according to claim 8 wherein said supporting base is rectangular in shape and having a generally rectangular top panel hingedly connected to a top front edge of said front rectangular panel, said top panel having an extension arm extending rearwardly from a rear edge therein and adapted to engage with a horizontal slot opening formed in said vertical planar board when said top panel is in a horizontal position.

10. A foldable stand according to claim 9 including an additional elastic cord mounted between said top panel and said vertical planar board and adapted to maintain said top panel normally in said horizontal position.

11. A foldable stand according to claim 10 wherein said extension arm is disengageable from said horizontal slot in said vertical planar board by pulling said top panel forward and pivoting upward relative to said front edge against elastic tension of said additional elastic cord while said side panels are pushed outwards at said vertical middle fold lines for folding said base to a collapsed condition to facilitate folding said stand into the folded condition.

12. A foldable stand according to claim 11 wherein said top panel is divided into a left top panel and a right top panel with a downwardly extending semi-circular cut out Conned at the front edge of said front rectangular panel, said semi-circular cut out extending between said left top panel and said right top panel.

13. A foldable stand according to claim 12 wherein said right top panel includes a first extension arm formed in a rear edge therein operative for engaging with a first horizontal slot opening formed in said vertical planar board when said right top panel is located in a horizontal position, and said left top panel also includes a second extension arm formed in a rear edge therein operative for engaging with s second horizontal slot opening formed in said vertical planar board, when said left top panel is located in a horizontal position.

14. A foldable stand according to claim 13 including a first elongated elastic cord mounted between said right top panel and said vertical planar board and operative to maintain said right top panel normally in said horizontal position, and as second elongated elastic cord mounted between said left top panel and said vertical planar board and operative to maintain said left top panel normally in said horizontal position, said first extension arm and said second extension arm being disengageable with said first horizontal slot and said second horizontal slot respectively when said right top panel and said left top panel are pivoted upwards while said side panels of said supporting base are pushed outwards in said vertical middle fold line of both said panels for folding said supporting base and subsequently said vertical planar board to a folded collapsed condition.

* * * * *